US010883250B2

(12) United States Patent
Wormald

(10) Patent No.: US 10,883,250 B2
(45) Date of Patent: Jan. 5, 2021

(54) DREDGING APPARATUS AND METHOD OF DREDGING

(71) Applicant: Daniel J Wormald, Launceston (GB)

(72) Inventor: Daniel J Wormald, Launceston (GB)

( * ) Notice: Subject to any disclaimer, the term of this patent is extended or adjusted under 35 U.S.C. 154(b) by 0 days.

(21) Appl. No.: 15/559,555

(22) PCT Filed: Mar. 18, 2016

(86) PCT No.: PCT/GB2016/050767
§ 371 (c)(1),
(2) Date: Sep. 19, 2017

(87) PCT Pub. No.: WO2016/147009
PCT Pub. Date: Sep. 22, 2016

(65) Prior Publication Data

US 2018/0044881 A1 Feb. 15, 2018

(30) Foreign Application Priority Data

Mar. 19, 2015 (GB) ..... 1504671.7

(51) Int. Cl.
*E02F 5/00* (2006.01)
*E02F 3/18* (2006.01)
*E02F 3/92* (2006.01)

(52) U.S. Cl.
CPC ..... *E02F 5/006* (2013.01); *E02F 3/188* (2013.01); *E02F 3/9262* (2013.01); *E02F 3/9281* (2013.01); *E02F 3/9293* (2013.01)

(58) Field of Classification Search
CPC ..... E02F 5/006; E02F 3/188; E02F 3/9262; E02F 3/9281; E02F 3/9293
See application file for complete search history.

(56) References Cited

U.S. PATENT DOCUMENTS 541,513 A 6/1895 Van Wagenen
543,637 A * 7/1895 Bates ..... E02F 3/925 37/323

(Continued)

FOREIGN PATENT DOCUMENTS

FR 417535 A 11/1910
GB 1383089 A 2/1975

(Continued)

OTHER PUBLICATIONS

Patents Act 1977: Search report under section 17, GB1504671.7, dated Sep. 4, 2015, 2 pages.

(Continued)

*Primary Examiner* — Tara Mayo-Pinnock
(74) *Attorney, Agent, or Firm* — Christopher McKeon; Jason Saunders; Arnold & Saunders, LLP

(57) ABSTRACT

A dredging head assembly for deploying on the bed of a body of water, is provided, the assembly comprising a cutter housing having a cutting opening for extending over a section of the bed from which material is to be removed; a cutting assembly disposed within the cutter housing, the cutting assembly operable through the cutting opening in the cutter housing to loosen material from the bed; and an outlet opening in the cutter housing for removing water and entrained material from within the cutter housing under suction; wherein the cutter housing comprises a plurality of holes therein, in use water being drawn into the cutter housing through the holes under the action of reduced fluid pressure within the cutter housing. A dredging assembly comprising the dredging head assembly and a method of dredging are also provided.

21 Claims, 7 Drawing Sheets

(56) References Cited

U.S. PATENT DOCUMENTS

| | | | | | |
|---|---|---|---|---|---|
| 2,446,573 | A * | 8/1948 | Cameron | B65G 53/42 | 406/71 |
| 2,995,842 | A * | 8/1961 | Korste | E02F 3/925 | 37/309 |
| 4,011,727 | A * | 3/1977 | Suzuki | E02F 5/104 | 16/223 |
| 4,083,134 | A * | 4/1978 | Oterdoom | E02F 3/9281 | 37/333 |
| 4,129,992 | A * | 12/1978 | Carlsson | E02F 5/104 | 37/367 |
| 4,939,854 | A * | 7/1990 | Boren | E02F 3/188 | 172/42 |
| 6,209,965 | B1 * | 4/2001 | Borns | E02F 3/925 | 299/17 |
| 6,374,519 | B1 * | 4/2002 | Beaumont | E02F 3/88 | 37/307 |
| 2003/0177671 | A1 * | 9/2003 | Dutton | E02F 3/188 | 37/317 |
| 2010/0126047 | A1 * | 5/2010 | Drabble | E02F 3/8841 | 37/307 |
| 2014/0345170 | A1 | 11/2014 | Southerland et al. | | |
| 2015/0143726 | A1 * | 5/2015 | Lewis | E02F 3/9243 | 37/318 |
| 2018/0328000 | A1 * | 11/2018 | Van Rompay | E02F 3/907 | |

FOREIGN PATENT DOCUMENTS

| | | | |
|---|---|---|---|
| GB | 1518439 | A | 7/1978 |
| GB | 2015624 | A | 9/1979 |
| JP | S59217840 | A | 12/1984 |
| SU | 757648 | A1 | 8/1980 |
| WO | 2012153169 | A1 | 11/2012 |
| WO | 2013009172 | A1 | 1/2013 |
| WO | 2013175366 | A1 | 11/2013 |

OTHER PUBLICATIONS

International Search Report, PCT/GB2016/050767, dated Jun. 28, 2016, 5 pages.

* cited by examiner

DREDGING APPARATUS AND METHOD OF DREDGING

The present invention relates to an apparatus for dredging, in particular for removing material, such as sediment, from the bed of a body of water, such as a lake, river, sea or ocean. The present invention also relates to a method of dredging.

Dredging is commonly applied to the bed of bodies of water to increase the depth of water, for example to clear or improve a water way, clear or create new moorings, and the like. Apparatus and methods for dredging material from the bed of a body of water are known in the art and generally fall into a number of different categories. A first technique employs a so-called 'clamshell', a bucket formed from two moveable halves, which is deployed in an open position to the bed to scoop material from the bed. The clamshell is closed and then raised and the contents of the clamshell deposited away from the dredging location, for example being transported by a ship or barge. A second technique employs one or a buckets that are moved in a pattern from the surface to the bed and back. The buckets are oriented to scoop material from the bed and return it to the surface.

An alternative to the aforementioned mechanical systems for capturing and moving material from the bed is the use of a pressurised jet of fluid, in particular water. Water under pressure is injected into the bed below the surface, the effect of which is to fluidise the material of the bed, which is then allowed to flow away from the dredging site.

A range of techniques employ suction. In general, suction techniques employ a vacuum to raise material from the bed, typically entrained in a flow of water. The suction technique may employ a simple tube, through which water and entrained material is drawn from the bed by a vacuum. The suction technique may employ a cutter, that is a device mounted at the suction inlet of the suction tube. The cutter device operates to loosen material at the bed, which is then entrained with water and drawn up the suction tube. A rotating auger may also be employed to loosen material at the bed for removal by suction, in the same manner.

A further technique employs a so-called 'lift' effects, that is the use of a jet of fluid, such as air or water, entrain a stream of water and material from the bed using the Venturi effect.

Dredging is an established art and has been practised in its various forms for many years. Recent examples of disclosures of dredging apparatus are as follows:

WO 2012/153169 discloses an apparatus and method for the dredging of sediments from the seabed. The apparatus employs the suction technique and comprises a submersible pump providing with an inlet and a discharge opening. An impellor is mounted for rotation between the inlet and discharge opening. A suction head is connected to the inlet of the pump and has a suction opening that is sized according to the working range of the pump.

WO 2013/009172 concerns a drag head and trailing suction hopper dredger. The drag head is arranged to be dragged across the bed of the a body of water and comprises a suction section, in which an underpressure cane be generated to suck material from the bed through a suction opening into a suction chamber. A heel section is provided to guide the drag head along the bed. The suction section is preferably rotatably mounted to the heel section. Material leaves the suction chamber through an outlet for transport in a suction tube, for example for recovering to the surface.

WO 2013/175366 discloses a suction head for a dredging vessel and a method of dredging using the same. The suction head has a suction opening on its lower side and has a connection for a suction conduit extending from a dredging vessel. A visor having a curved wall is rotatable around a shaft between a raised position and a lowered position. The curved wall forms a water tight seal with a wall portion of the suction head. The visor is provided with a toothed beam having cutting tools for penetrating the bed. Water and material from the visor flow through an opening in the rear wall of the visor into the suction head. The opening can be closed by means of a closure member.

More recently, a method and apparatus for underwater dredging is described and shown in US 2014/0345170. The apparatus comprises a centrally positioned pump, around which are arranged a plurality of cutting assemblies. In operation, material at the bed is loosened by the cutting assemblies and passes to the inlet of the pump assembly for recovery to a surface vessel.

A suction-dredge sucking assembly is disclosed in SU 757648.

Dredging assemblies are disclosed in GB 1518439, GB 1383089, GB 2015624 and U.S. Pat. No. 541,513.

A particular problem with all dredging operations is the generation of a plume of material from the bed, that is a body of material suspended in the water. While the known dredging assemblies may be effective in dislodging and loosening material from the seabed, much of the material forms a plume in the region of the dredging assembly. Material in the plume is typically not recovered during the dredging operation, but rather is dispersed in the region of the dredging operation and, if a current is flowing in the body of water, extends downstream of the dredging operation. The dispersion of material in a plume in this manner is damaging to the surrounding aquatic environment.

Accordingly, there is a need for an improved assembly for dredging, in particular an assembly that reduces, or more preferably eliminates, the formation of a plume of material during dredging operations and allows material from the bed to be efficiently recovered and removed from the dredging site.

According to a first aspect of the present invention, there is provided a dredging head assembly for deploying on the bed of a body of water, the assembly comprising:

a cutter housing having a cutting opening for extending over a section of the bed from which material is to be removed;

a cutting assembly disposed within the cutter housing, the cutting assembly operable through the opening in the cutter housing to loosen material from the bed; and an outlet opening in the cutter housing for removing water and entrained material from within the cutter housing under suction;

wherein the cutter housing comprises a plurality of holes therein, in use water being drawn into the cutter housing through the holes under the action of reduced fluid pressure within the cutter housing.

In a further aspect, the present invention provides a dredging assembly comprising:

a cutter housing having a cutting opening for extending across a section of the bed from which material is to be removed;

a cutting assembly disposed within the cutter housing, the cutting assembly operable through the cutting opening in the cutter housing to loosen material from the bed;

an outlet opening in the cutter housing; and a suction tube connected to the outlet opening for removing water and entrained material from within the cutter housing under suction through the opening;

wherein the cutter housing comprises a plurality of holes therein, in use water being drawn into the cutter housing through the holes under the action of reduced fluid pressure within the cutter housing.

In a still further aspect, the present invention provides a method for dredging material from the bed of a body of water, the method comprising:

providing a cutter housing, the cutter housing having a cutting opening extending across a portion of the bed;

conducting a cutting operation within the cutter housing through the cutting opening to loosen material from the portion of the bed;

reducing the pressure of fluid within the cutter housing relative to the surrounding water pressure by applying suction to the interior of the cutter housing through an outlet opening in the cutter housing, material from within the cutter housing leaving through the outlet opening; and allowing water to flow into the cutter housing through a plurality of holes in the cutter housing under the action of the pressure differential between the fluid at reduced pressure within the cutter housing and the pressure of the surrounding water.

In the case of the present invention, material from the bed of the body of water is loosened by the cutting assembly, operating from within the housing and through the opening in the housing. By applying suction to the interior of the cutter housing through the outlet opening, the loosened material and water are drawn out of the housing and may be recovered, for example through a suction pipe to a surface vessel for subsequent disposal. The cutter housing acts to prevent loosened material from leaving and entering the surrounding water and confines substantially all of the loosened material within the interior of the cutter housing. The formation of a plume in the vicinity of the cutter housing is prevented by allowing water to enter the interior of the cutter housing through the plurality of holes in the cutter housing. In this way, the general flow of water is into the interior of the cutter housing, the inward flow of water entraining any loosened material that may escape the housing.

The dredging head assembly of the present invention comprises a cutter housing. The cutter housing accommodates a cutting assembly, as described in more detail hereinafter. The cutter housing can be considered to have a footprint, that is the area of the bed defined by the perimeter of the cutter housing when in position on the bed and the assembly is operating. The cutter housing encloses the cutting assembly, such that, when in use, the action of the cutting assembly to loosen material of the bed occurs within the footprint of the cutter housing.

The cutter housing may be considered to have an upper portion and a lower portion, as defined with the cutter housing in position on the bed and with the assembly in operation. The upper portion and lower portion of the cutter housing form an enclosure that surrounds the cutting assembly therein and defines the interior of the cutter housing. The lower portion of the cutter housing has an opening therein, such that a portion of the bed is exposed to the interior of the cutter housing. The cutting assembly operates within the cutter housing to loosen material from this exposed portion of the bed.

The cutter opening has an edge defining the opening. In one embodiment, the cutting opening in the lower portion of the cutter housing is defined by a lower edge of the cutter housing.

The cutting assembly is disposed within the interior of the cutter housing. That is, the cutting assembly is disposed above or at the level of the edge of the cutting opening. In this way, the cutter assembly operates to loosen material from the exposed portion of the bed at or above the level of the edge of the cutting opening, for example the lower edge of the cutter housing. It is preferred that the cutting assembly is level with the edge of the cutting opening, that is the point at which the cutting assembly applies a cutting action to the bed is level with the edge of the cutting opening.

The lower portion of the cutter housing preferably comprises a side wall assembly comprising one or more side walls. The side wall assembly preferably has a lower edge that forms the lower edge of the cutter housing that defines the cutting opening in the lower portion of the cutter housing, as noted above.

In an alternative arrangement, the lower portion of the cutter housing may comprise a floor extending between opposing sides of the side wall assembly. In this case, the aforementioned cutting opening in the lower portion of the cutter housing is formed in the floor.

In use, the dredging head assembly is moved across the bed. Accordingly, the cutter housing can be considered to have a front and a rear, as defined by the direction of movement of the cutter housing. The lower portion of the cutter housing is in contact with the bed during operation and forms a seal with the bed, that prevents the normal flow of water into or out of the interior of the cutter housing between the lower edge or floor of the cutter housing and the bed.

The lower portion of the cutter housing may have a constant depth between the front and rear of the cutter housing. In one preferred embodiment, the front portion of the lower portion of the cutter housing has a first depth and the rear portion of the lower portion of the cutter housing has a second depth, with the first depth being less than the second depth. Preferably, the change in depth between the front portion and rear portion of the lower portion of the cutter housing is continuous.

As noted above, the cutter housing has an upper portion, which together with the lower portion forms an enclosure and defines the interior of the cutter housing.

The cutter housing is provided with an outlet opening therein. The outlet opening is preferably provided in the upper portion of the cutter housing. In operation of the dredging head assembly, material loosened from the bed and water are removed from the interior of the cutter housing, in particular by applying suction to the interior of the cutter housing through the outlet opening.

A suction pipe may be connected to the outlet opening in the cutter housing for transporting material and water away from the cutter housing, for example to a surface vessel. The suction pipe is connected to a pump or other device for providing suction to the interior of the cutter housing, as is known in the art.

The cutter housing is further provided with a plurality of holes therein. Preferably, the holes are arranged in at least the upper portion of the cutter housing. The holes communicate the interior of the cutter housing with the exterior and allow water to be drawn into the interior of the cutter housing when the assembly is in use. In particular, in operation of the assembly, the fluid pressure within the cutter housing is reduced relative to the exterior water pressure, thereby causing water to be drawn into the cutter housing through the plurality of holes.

The holes may have any suitable shape. In one preferred embodiment, the holes are each generally circular. In an alternative preferred embodiment, the holes in the cutter housing are in the form of elongate slots or slits. In this respect, the diameter referred to herein is a reference to the length of the slot or slit.

The holes in the cutter housing may be of the same shape. Alternatively, the cutter housing may comprise holes therein having two or more different shapes.

The holes may have the same area, that is the area of the opening in the cutter housing formed by the hole, or be different in area. Preferably, the holes all have the same area.

The size of the holes, that is the area of each hole, may be selected according to the type of material forming the bed of the body of water to be dredged. For example, holes of smaller area may be employed when the material has a small average particle size, such as mud or silt. Holes having a larger area may be employed when the material of the bed has a larger average particle size, for example coarse sand or gravel.

The holes may have a diameter of up to 100 mm, preferably up to 90 mm, more preferably up to 80 mm, more preferably still up to 70 mm, still more preferably up to 60 mm. In one preferred embodiment, the holes have a diameter of up to 50 mm. In this respect, the diameter of the hole is a reference to the largest dimension of the hole.

The holes may be arranged in any suitable pattern in the cutter housing. Preferably, the holes are evenly distributed in the cutter housing, more preferably evenly distributed across the upper portion of the housing. In one embodiment, the holes are arranged in a plurality of lines, preferably straight lines, extending across the cutter housing, more preferably lines extending from the front of the cutter housing to the rear.

The dredging head assembly further comprises a cutting assembly disposed within the cutter housing, as discussed hereinbefore. The cutting assembly is disposed within the cutter housing so as to be above the opening in the lower portion of the cutter housing when in use. As also noted above, the cutting assembly preferable has the position of its cutting action level with the edges of the opening in the cutter housing. The action of the cutting assembly is to loosen material at the opening in the cutter housing. In operation, in the case of a bed formed from soft material, such as mud or silt, the lower portion of cutter housing may sink into the bed and extend into the bed below its surface. In this case, the action of the cutting assembly is to loosen material from the bed within the cutter housing. Material is loosened from below the cutter housing due to water turbulence generated within the device, in particular by the action of the cutting assembly.

As discussed, the action of the cutting assembly is to loosen material from the bed of the body of water, such that the loosened material may be removed from within the cutter housing through the outlet opening. The dredging head assembly may employ any suitable cutting assembly.

For example, the cutting assembly may comprise one or more water jet assemblies, that is assemblies for directing one or more jets of water at the bed to loosen the material of the bed. In this case, the dredging head assembly is provided with a supply of pressurised water, for example from a pump on a surface vessel supplying pressurised water through one or more high pressure lines to the dredging head assembly and the water jet cutting assembly within the cutter housing. In operation, the one or more water jet assemblies operate to loosen the material of the bed through the opening in the lower portion of the cutter housing.

More preferably, the cutting assembly comprises a rotary cutter. The rotary cutter comprises a rotatable cutter and a drive assembly for rotating the rotatable cutter. The rotatable cutter preferably comprises one or more cutting elements, such as cutting teeth, blades and the like, mounted on a shaft or drum. Suitable rotary cutters are known in the art. The drive assembly rotates the rotatable cutter, when in operation. Suitable drive assemblies are known in the art. Examples of suitable drive assemblies are those comprising a motor, such as an electric or hydraulic motor.

The rotary cutter extends across a portion of the interior of the cutter housing and operate to loosen material through the opening in the lower portion of the cutter housing. Preferably, the rotary cutter extends across the entire cutting opening in the cutter housing.

The rotary cutter is preferably mounted to extend laterally across the interior of the cutter housing, that is substantially perpendicular to a central line extending from the front the to rear of the cutter housing.

The cutting assembly is mounted for operation within the cutter housing, as described above. The dredging head assembly may comprise a single cutting assembly. Alternatively, the dredging head assembly may comprise two or more cutting assemblies. In one embodiment, the dredging head comprises two cutting assemblies, in particular two rotary cutters.

In embodiments in which the dredging head assembly comprises a plurality of cutting assemblies, the cutting assemblies may be arranged side by side within the cutter housing. In one preferred embodiment, the dredging head comprises a first cutting assembly and a second cutting assembly, the first cutting assembly being mounted in a front position and the second cutting assembly being mounted to the rear of the first cutting assembly.

In embodiments in which the dredging head assembly comprises a plurality of cutting assemblies, the cutting assemblies may extend at the same level within the cutter housing, that is be disposed at the same height relative to the bed when in use. In one preferred embodiment, the dredging head comprises a first cutting assembly and a second cutting assembly, with the first cutting assembly being disposed in the cutter housing to be at a first height relative to the bed, when in use, and the second cutting assembly being disposed in the cutter housing to be at a second height relative to the bed, when in use, the first height being greater than the second height. In this respect, height within the cutter housing is a reference to the distance from the lowest portion of the cutter housing. Preferably, the first cutting assembly is in front of the second cutting assembly. In this way, a single pass of the dredging head across the bed loosens material initial at a first depth and thereafter at a second depth.

In embodiments in which the dredging head assembly comprises a plurality of cutting assemblies, the cutting assemblies may be arranged to be at different distances from the opening in the lower portion of the cutter housing. More preferably, the plurality of cutting assemblies are at the same distance from the opening in the lower portion of the cutter housing.

In embodiments in which the dredging head assembly comprises a plurality of cutting assemblies, it is preferred that the interior of the cutter housing comprises a plurality of compartments, the compartments being defined by partition walls extending within the interior of the cutter housing. The plurality of cutting assemblies is distributed in the plurality of compartments, preferably with each compartment comprising a single cutting assembly. The compartments may be interconnected by openings in the partition walls, to allow water and material to flow from a compartment to an adjacent compartment and to the outlet opening in the cutter housing. Alternatively or in addition thereto, each compartment may be provided with an outlet opening in the cutter housing, to allow water and material to be removed from the said compartment during operation. As a further alternative, the dredging head assembly may comprise one or more internal lines or conduits, to allow water and material to flow from each compartment to the outlet opening for removal from the cutter housing.

The dredging head assembly may comprise one or more stabilizer assemblies to stabilise dredging head and maintain it in the correct orientation and position relative to the bed, when in operation. Preferably, the stabilizer assemblies extend from the exterior of the cutter housing. In one preferred embodiment, the dredging head assembly comprises one or more stabilizer assemblies mounted to the front portion of the cutter housing and/or one or more stabilizer assemblies mounted to the rear portion of the cutter housing, most preferably both. A most suitable stabilizer assembly is one comprise one or more wheels or rollers that bear on the bed.

In operation, the dredging head assembly will sink or be pushed into the bed, such that the edge of the cutting opening is below the upper surface of the bed. The depth of penetration of the dredging head assembly into the bed will depend upon such factors as the weight of the assembly and the nature of the material of the bed, such as density and particle size. The stabilizer assemblies act as a guide for determining the maximum cutting depth of the assembly in operation and act to maintain the assembly at the required cutting depth. The stabilizer assemblies may be adjustable, to allow the cutting depth to be adjusted.

Embodiments of the present invention will now be described, by way of example only, having reference to the accompanying drawings, in which.

Figure 1:
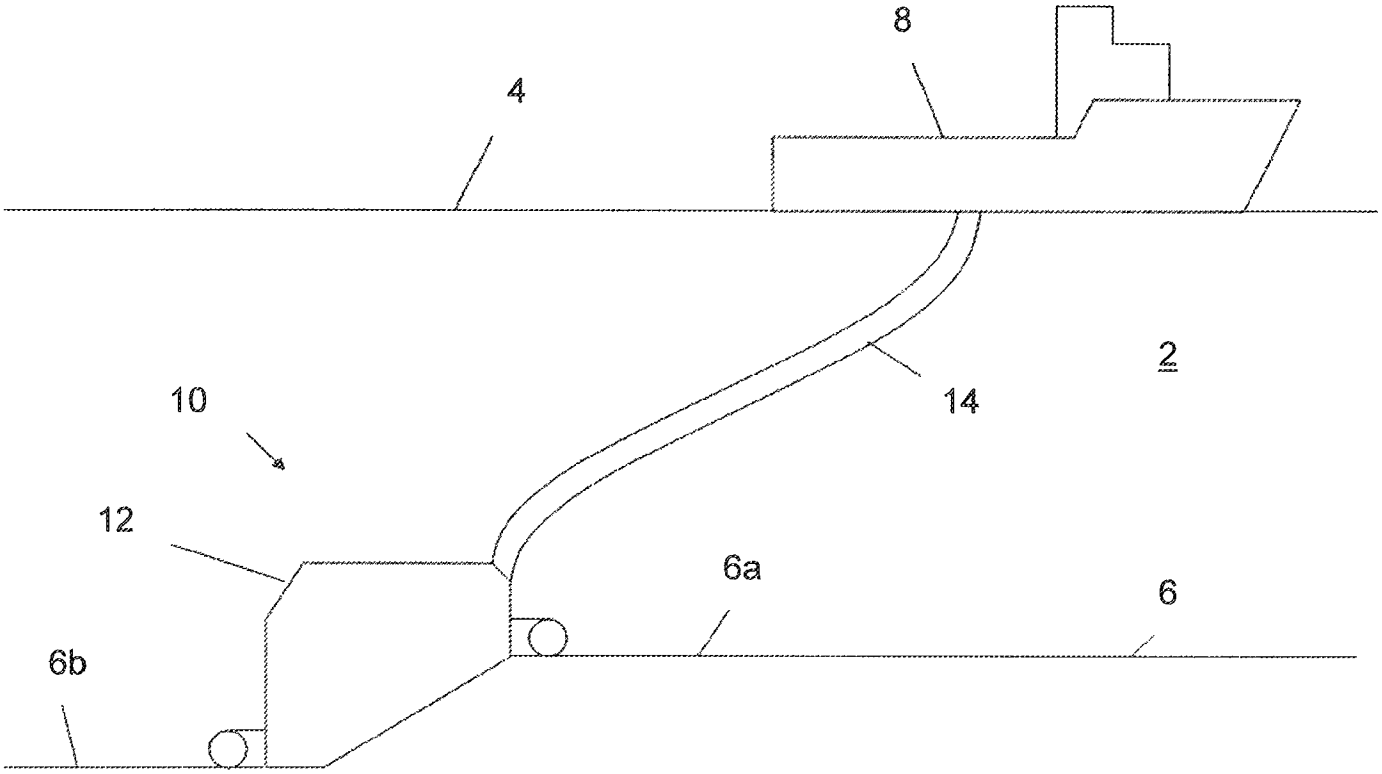
FIG. 1 is a diagrammatical representation of a dredging assembly and dredging head assembly of the present invention deployed in a body of water from a surface vessel.

Turning to FIG. 1, there is shown a body of water, generally indicated as 2, having a surface 4 and a bed 6. A dredging vessel 8 at the surface 4 of the body of water 2 has deployed therefrom a dredging assembly, generally indicated as 10, comprising a dredging head assembly 12 connected to the vessel 8 by a suction line 14. In operation, the vessel 8 and the dredging assembly 10 is moving from the left to the right as viewed in FIG. 1, with the portion 6*a* of the bed 6 to be dredged appearing at the right of the dredging head assembly 12 and the dredged portion 6*b* of the bed 6 extending to the left of the dredging head assembly 12.

Figure 2:
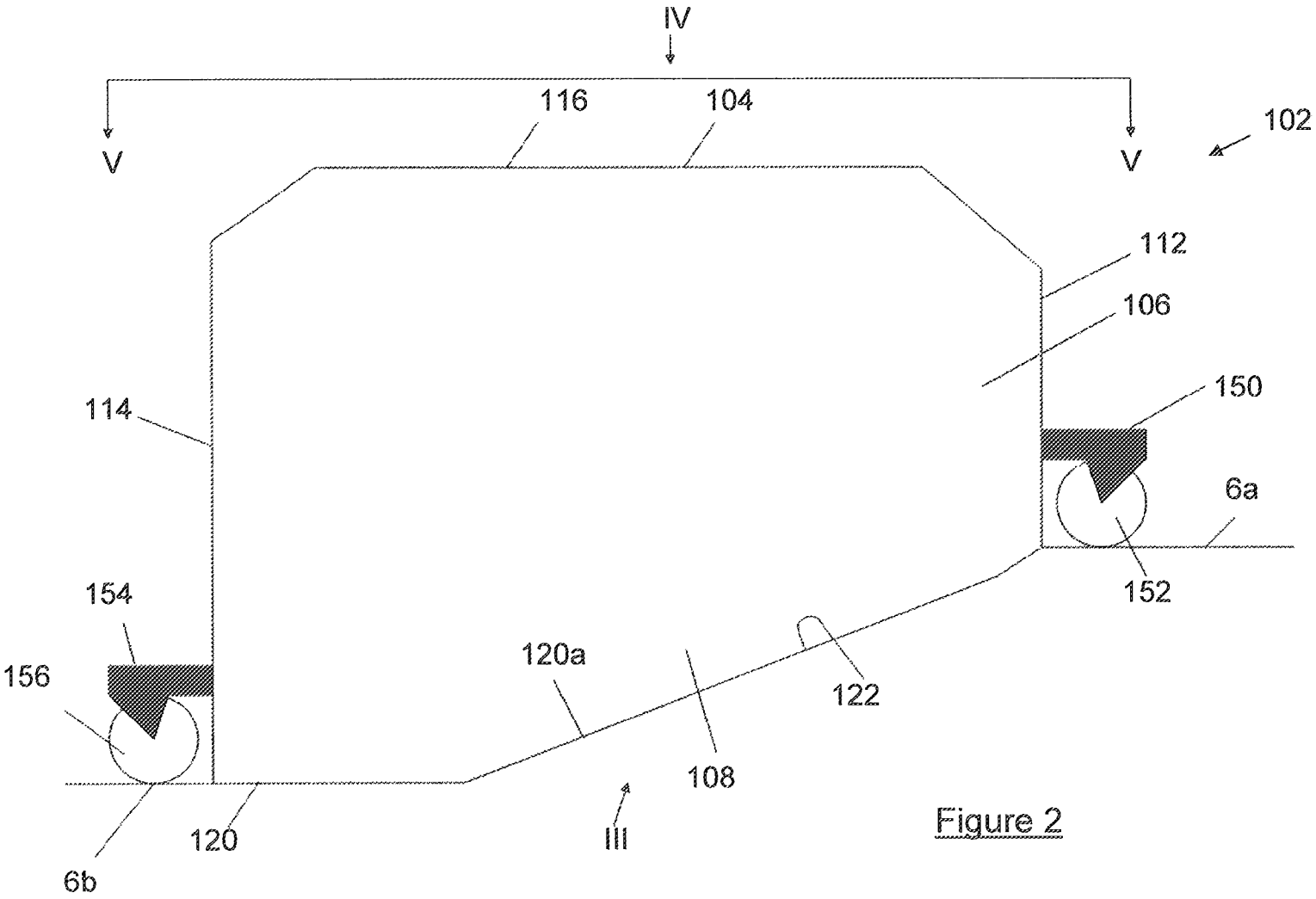
FIG. 2 is a side view of one embodiment of a dredging head assembly of the present invention.
Figure 3:
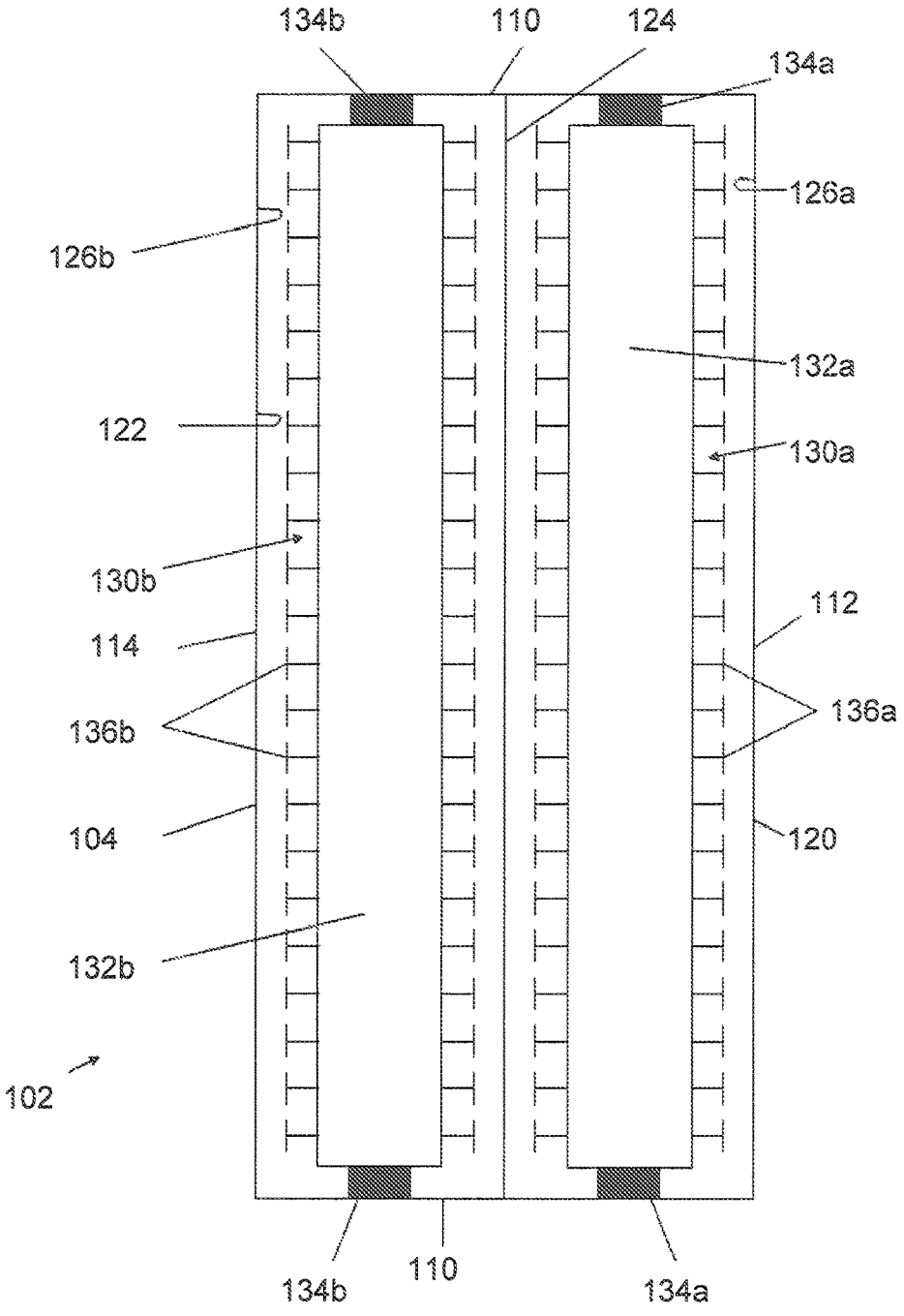
FIG. 3 is a bottom view of the dredging head assembly of FIG. 2 in the direction of arrow III.

One embodiment of a dredging head assembly is shown in FIGS. 2 to 5. The dredging head assembly, generally indicated as 102, is shown in FIG. 2 deployed on the bed 6 during a dredging operation. The dredging head assembly 102 comprises a cutter housing 104 having an upper housing portion 106 and a lower housing portion 108. In operation, the lower housing portion 106 extends below the level of the bed 6*a* to be dredged, as shown in FIG. 2.

The cutter housing 104 comprises opposing end walls 110, a front wall 112, a rear wall 114 and a top 116. The end walls 110, front wall 112 and rear wall 114 have a lower edge 120, which defines an opening 122 in the lower portion 108 of the cutter housing 104. As can be seen in FIG. 2, the rear wall 114 is deeper than the front wall 112 and each end wall 110 comprises an angled lower edge portion 120*a* that slopes forwards and upwards towards the front wall 112.

The cutter housing 104 comprises a partition wall 124 extending between the opposing end walls 110, which divides the interior of the cutter housing into a front portion 126*a* and a rear portion 126*b*.

The dredging head assembly 102 comprises a first cutting assembly in the form of a rotary cutter 130*a* disposed in the front portion 126*a* of the interior of the cutter housing 104. The rotary cutter 130*a* comprises a drum 132*a* rotatably mounted by a hub assembly 134*a* at each end to the respective end wall 110. A plurality of T-shaped cutting blades 136*a* extend from the drum 132*a*. As shown in the figures, the rotary cutters comprise four cutting blades. The number of cutting blades may be varied from that shown, for example providing the rotary cutters with fewer blades, such as 3 blades, or more blades, such as 5 or more.

A second cutting assembly in the form of a rotary cutter 130*b* is disposed in the rear portion 126*b* of the interior of the cutter housing 104 and is configured in an identical manner to the rotary cutter 130*a* of the first cutting assembly.

The rotary cutters 130*a*, 130*b* are arranged such that the ends of the blades 136*a*, 136*b* pass through a point level with the lower edge 120 of the cutter housing 104. In this way, the cutting action of the rotary cutters may be considered to be level with the lower edge 120 of the cutter housing 104.

The rotary cutters 130*a*, 130*b* are driven by a suitable motor or other drive means (not shown for clarity). The motor is preferably a hydraulic motor.

Figure 4:
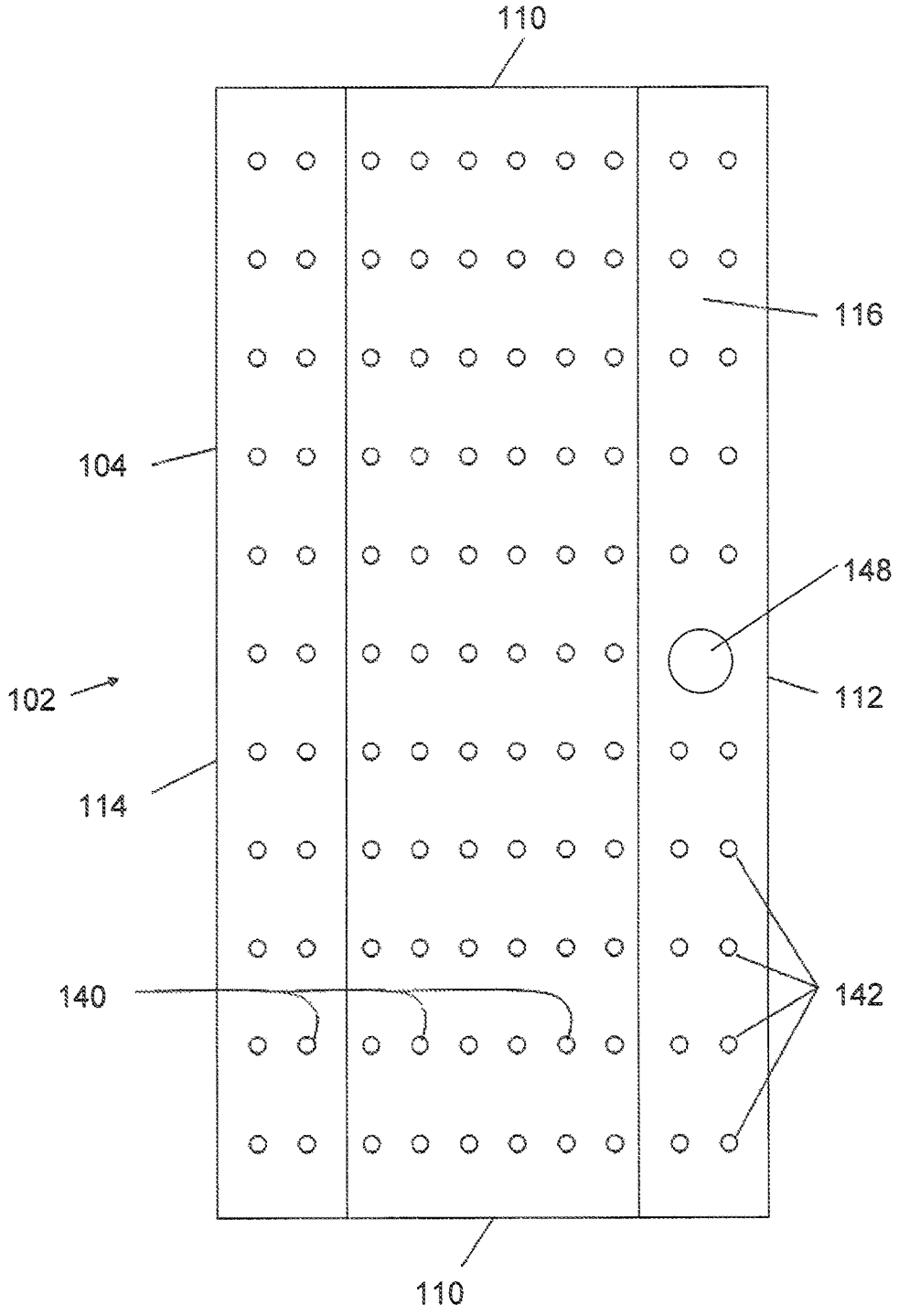
FIG. 4 is a top view of the dredging head assembly of FIG. 2 in the direction of arrow IV.
Figure 5:
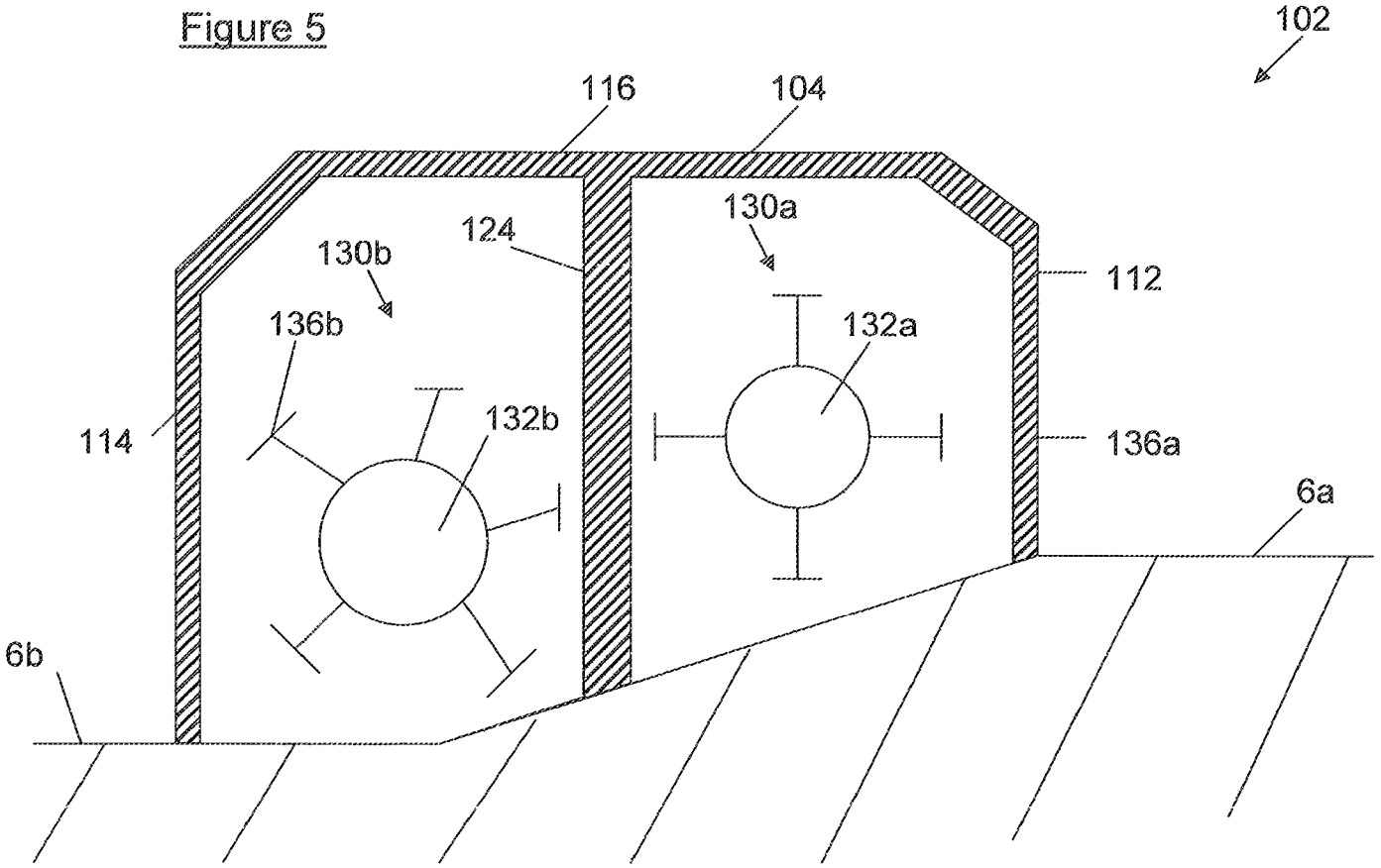
FIG. 5 is a cross-sectional view of the dredging head assembly of FIG. 2 along the line V-V.

As shown in FIG. 4, the centre of the front rotary cutter 130*a* is higher than the centre of the second rotary cutter 130*b*. However, the centre of both rotary cutters 130*a*, 130*b* are at the same distance above the lower edge 120 of the cutter housing 104.

The top 116 of the cutter housing 104 is shown in FIG. 4. As can be seen, the top 116 is provided with a plurality of circular holes 140 connecting the interior of the cutter housing 104 with the surrounding water. The holes 104 are arranged in a plurality of rows 142, each row extending from the front wall 112 to the rear wall 114. The front wall 112 and the rear wall 114 are also each provided with a plurality of holes therein, in analogous manner to the holes in the top 116.

The cutter housing 104 further comprises an outlet opening to allow connection to a suction line 14, as shown in FIG. 1, and through which water and material from the interior of the cutter housing 104 may be removed during operation.

The dredging head assembly 102 is provided with a front stabilizer assembly 150 extending from the front wall 112 and comprising a roller 152 bearing on the bed 6*a* to the front of the cutter housing 104. A rear stabilizer assembly 154 extends from the rear wall 114 and comprises a roller 152 bearing on the bed portion 6*b* to the rear of the cutter housing 104.

In operation, the dredging head assembly 102 is deployed on the bed of the body of water, for example from a surface vessel, as illustrated in FIG. 1. The cutter housing 104 is in contact with the bed. In particular, the edge 120 of the lower portion 108 of the cutter housing 104 is in contact with the bed and, in the case of a bed containing soft or loose material, such as mud or sand, can extend into the bed below the surface. In this way, the cutter housing 104, together with the bed, encloses the rotary cutters 130*a*, 130*b*. The rotary cutters 130*a*, 130*b* are rotated, causing the cutting blades 136*a*, 136*b* to loosen the portion of the bed exposed by the opening in the lower portion 108 of the cutter housing. Suction is applied to the interior of the cutter housing 104 by way of the suction tube 14, which draws water and loosened material from the bed to leave the interior of the cutter housing 104 through the outlet opening and along the suction tube 14. The water and material are recovered at the vessel 8, for storage, transport and/or disposal at a different location.

Under the action of the suction applied to the dredging head assembly 102 by means of the suction tube 14, the fluid pressure within the cutter housing 104 is lower than the surrounding pressure outside the cutter housing. Consequently, water is caused to flow into the cutter housing 104 through the holes 140. This inflow of water prevents material loosened from the bed due to the cutting action from leaving the cutter housing 104 and substantially prevents the formation of a plume in the water around the dredging head assembly.

The arrangement of the cutter housing 104 and the rotary cutters 130*a*, 130*b* loosens material from the bed in two stages. In a first stage, the front rotary cutter 130*a* loosens material to a first depth, corresponding to the depth of the front wall 112 of the cutter housing 104. In a second stage, the rear rotary cutter 130*b* loosens material to second depth, corresponding to the depth of the rear wall 114 of the cutter housing 104.

Figure 6:
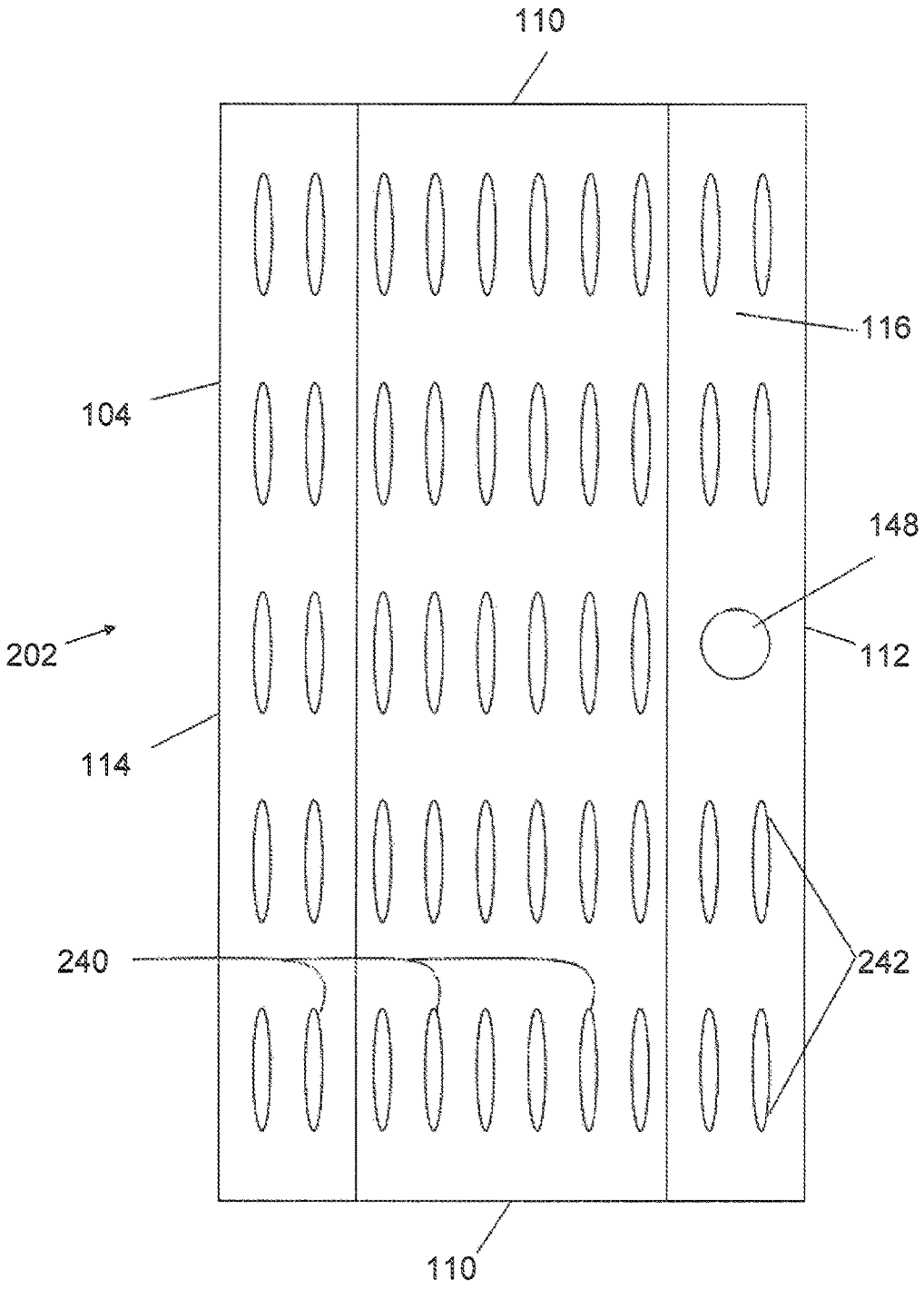
FIG. 6 is a top view of a dredging head assembly showing an alternative arrangement for the holes in the cutter housing.

Turning to FIG. 6, there is shown a plan view of a dredging head assembly of an alternative embodiment of the present invention. The dredging head assembly, generally indicated as 202, has the same general configuration and arrangement as shown in FIGS. 1 to 5 and described above. The embodiment of FIG. 6 differs in respect of the shape and arrangement of the holes. As can be seen in FIG. 6, the cutter housing 104 is provided with holes in the form of slots 240 arranged in rows 242 in the upper portion of the cutter housing 104, in analogous manner to the circular holes of the embodiment of FIGS. 1 to 5.

It will be appreciated that the dredging head assembly 102 may comprise a single cutter assembly, such as a single rotary cutter 130 of the type shown and described above. An embodiment of this kind is shown in cross-section in FIG. 7.

The dredging head assembly, generally indicated as 302, comprises a cutter housing 304 having an upper housing portion 306 and a lower housing portion 308. In operation, the lower housing portion 306 extends below the level of the bed to be dredged, in an analogous manner to that shown in FIG. 2.

Figure 7:
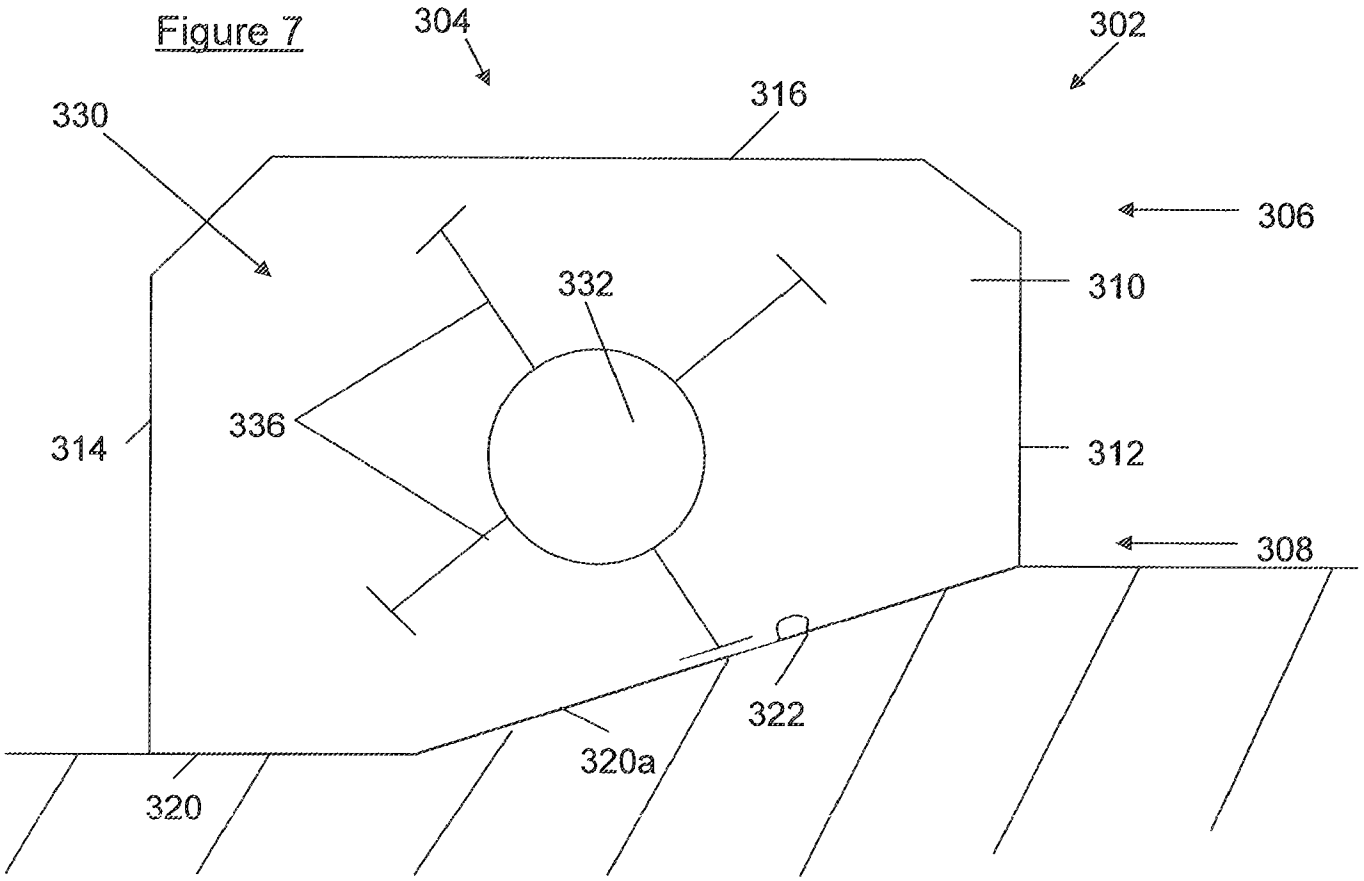
FIG. 7 is a cross-sectional view of a further alternative dredging head assembly employing a cutting assembly having a single rotary cutter.

The cutter housing 304 comprises opposing end walls 310, a front wall 312, a rear wall 314 and a top 316. The end walls 310, front wall 312 and rear wall 314 have a lower edge 320, which defines an opening 322 in the lower portion 308 of the cutter housing 304. As can be seen in FIG. 7, the rear wall 314 is deeper than the front wall 312 and each end wall 310 comprises an angled lower edge portion 320*a* that slopes forwards and upwards towards the front wall 312.

The dredging head assembly 302 comprises a cutting assembly in the form of a rotary cutter 330 disposed in the interior of the cutter housing 304. The rotary cutter 330 comprises a drum 332 rotatably mounted by a hub assembly at each end to the respective end wall 310. A plurality of T-shaped cutting blades 336 extend from the drum 332.

The rotary cutter 330 is arranged such that the ends of the blades 336 pass through a point level with the lower edge 320 of the cutter housing 304. In this way, the cutting action of the rotary cutters may be considered to be level with the lower edge 320 of the cutter housing 304.

The rotary cutter 330 is driven by a suitable motor or other drive means (not shown for clarity). The motor is preferably a hydraulic motor.

In other respects, the arrangement and operation of the dredging head assembly of FIG. 7 is directly analogous to that of the dredging head assembly shown in FIGS. 1 to 5 and described above.

The invention claimed is:

1. A dredging head assembly for deploying on the bed of a body of water, the assembly comprising:

a cutter housing having a cutting opening for extending over a section of the bed from which material is to be removed;

a cutting assembly enclosed within the cutter housing, the cutting assembly operable through the cutting opening in the cutter housing to loosen material from the bed; and an outlet opening in the cutter housing for removing water and entrained material from within the cutter housing under suction;

wherein the cutter housing comprises a plurality of holes therein, in use water being drawn into the cutter housing through the holes under the action of reduced fluid pressure within the cutter housing to reduce the formation of a plume of material during dredging operations.

2. The dredging head assembly according to claim 1, wherein the cutter housing has a floor, the cutting opening being formed in the floor.

3. The dredging head assembly according to claim 1, wherein the cutter housing has a front portion, a rear portion, an upper portion and a lower portion, the front portion of the lower portion of the cutter housing having a first depth and the rear portion of the lower portion of the cutter housing having a second depth, with the first depth being less than the second depth.

4. The dredging head assembly according to claim 3, wherein the change in depth from the front portion to the rear portion is continuous.

5. The dredging head assembly according to claim 1, wherein the plurality of holes in the cutter housing is arranged in an upper portion of the cutter housing.

6. The dredging head assembly according to claim 1, wherein the holes in the cutter housing are arranged in a plurality of lines extending across the cutter housing.

7. The dredging head assembly according to claim 6, wherein the lines of holes in the cutter housing extend from the front of the cutter housing to the rear of the cutter housing.

8. The dredging head assembly according to claim 1, wherein the cutting assembly comprises a rotary cutter.

9. The dredging head assembly according to claim 1, comprising a first cutting assembly and a second cutting assembly.

10. The dredging head assembly according to claim 9, wherein the first cutting assembly is disposed at a first height within the cutter housing and the second cutting assembly is disposed at a second height within the cutter housing, the first height being greater than the second height.

11. The dredging head assembly according to claim 9, wherein the cutter housing comprises a first compartment therein containing the first cutting assembly and a second compartment therein containing the second cutting assembly.

12. The dredging head assembly according to claim 11, wherein the cutter housing is provided with a first outlet opening communicating with the first compartment and a second outlet opening communicating with the second compartment.

13. The dredging head assembly according to claim 1, further comprising a stabilizer assembly extending from the cutter housing.

14. A dredging assembly comprising:

a dredging head assembly comprising:

a cutter housing having a cutting opening for extending across a section of the bed from which material is to be removed;

a cutting assembly enclosed within the cutter housing, the cutting assembly operable through the cutting opening in the cutter housing to loosen material from the bed;

an outlet opening in the cutter housing; and a suction tube connected to the outlet opening for removing water and entrained material from within the cutter housing under suction through the opening;

wherein the cutter housing comprises a plurality of holes therein, in use water being drawn into the cutter housing through the holes under the action of reduced fluid pressure within the cutter housing to reduce the formation of a plume of material during dredging operations.

15. A method for dredging material from the bed of a body of water, the method comprising:

providing a cutter housing, the cutter housing having a cutting opening extending across a portion of the bed;

conducting a cutting operation using a cutting assembly enclosed within the cutter housing through the cutting opening to loosen material from the portion of the bed;

reducing the pressure of fluid within the cutter housing relative to the surrounding water pressure by applying suction to the interior of the cutter housing through an outlet opening in the cutter housing, material from within the cutter housing leaving through the outlet opening; and allowing water to flow into the cutter housing through a plurality of holes in the cutter housing under the action of the pressure differential between the fluid at reduced pressure within the cutter housing and the pressure of the surrounding water to reduce the formation of a plume of material during dredging operations.

16. The method according to claim 15, wherein the cutter housing has a floor, the cutting opening being formed in the floor.

17. The method according to claim 15, wherein the cutter housing has a front portion, a rear portion, an upper portion and a lower portion, the front portion of the lower portion of the cutter housing having a first depth and the rear portion of the lower portion of the cutter housing having a second depth, with the first depth being less than the second depth.

18. The method according to claim 15, wherein the cutter housing has an upper portion, with the outlet opening being formed in the upper portion, material being removed from the upper portion of the cutter housing.

19. The method according to claim 15, wherein the cutting operation is performed by a rotary cutter.

20. The method according to claim 15, comprising conducting a first cutting operation using a first cutting assembly and thereafter conducting a second cutting operation using a second cutting assembly.

21. The method according to claim 20, wherein the first cutting operation cuts to a first depth and the second cutting operation cuts to a second depth, wherein the first depth is greater than the second depth.

* * * * *